US009268271B1

(12) United States Patent
Endo

(10) Patent No.: US 9,268,271 B1
(45) Date of Patent: Feb. 23, 2016

(54) FIXING DEVICE, IMAGE FORMING APPARATUS AND DRIVE LOAD REDUCTION METHOD OF THE FIXING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Sasuke Endo, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/525,348

(22) Filed: Oct. 28, 2014

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2017; G03G 15/2025; G03G 15/2075; G03G 2215/2035
USPC ..... 399/328, 329
See application file for complete search history.

(56) References Cited

U.S. PATENT DOCUMENTS

2002/0106211 A1* 8/2002 Suzuki et al. ..... 399/69
2006/0182474 A1* 8/2006 Naito et al. ..... 399/329

* cited by examiner

*Primary Examiner* — Erika J Villaluna
(74) *Attorney, Agent, or Firm* — Amin, Turocy & Watson, LLP

(57) ABSTRACT

In accordance with one embodiment, a fixing device comprises a fixing belt configured to be provided with a conductive layer; an induction current generating section configured to face the fixing belt in a thickness direction to heat the conductive layer through electromagnetic induction heating; an auxiliary heating section configured to face the induction current generating section across the fixing belt to increase the calorific value in the electromagnetic induction heating process; and a friction reducing member configured to be nipped between the auxiliary heating section and the fixing belt; wherein a lubricant is supplied between the friction reducing member and the fixing belt.

9 Claims, 6 Drawing Sheets

FIXING DEVICE, IMAGE FORMING APPARATUS AND DRIVE LOAD REDUCTION METHOD OF THE FIXING DEVICE

FIELD

Embodiments described herein relate generally to a fixing device, an image forming apparatus and a drive load reduction method of the fixing device.

BACKGROUND

Conventionally, there is a multi function peripheral (hereinafter referred to as an "MFP") and an image forming apparatus such as a printer and the like. The image forming apparatus is provided with a fixing device. The fixing device heats a conductive layer of a fixing belt through an electromagnetic induction heating method (hereinafter referred to as an "IH method") to fix a toner image on an image receiving medium through the heat of the fixing belt. For example, the fixing device includes an auxiliary heating section arranged to face an induction current generating section across the fixing belt. The auxiliary heating section concentrates the magnetic fluxes in the electromagnetic induction heating process to increase the calorific value of the fixing belt. In a case in which the auxiliary heating section is contacted with the fixing belt, the drive load of the fixing device may be increased.

DETAILED DESCRIPTION

Figure 1:
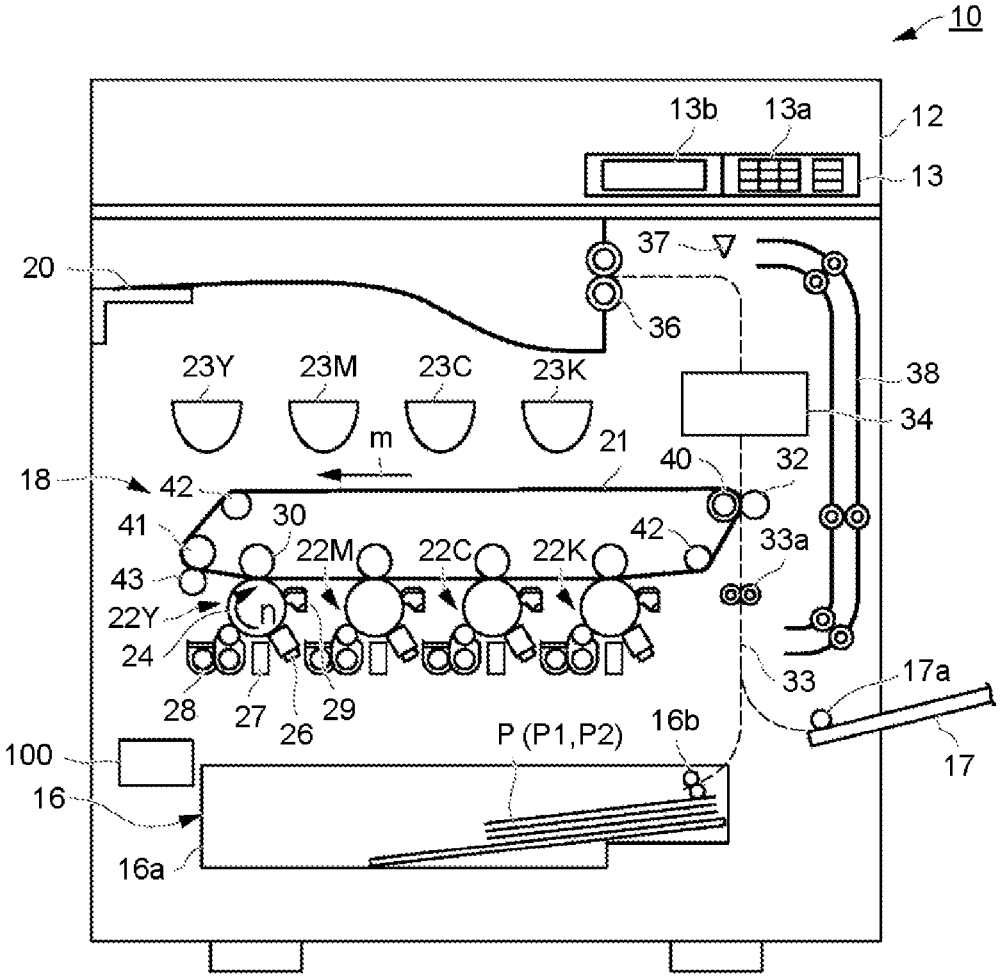
FIG. 1 is a side view of an image forming apparatus according to a first embodiment.

In accordance with one embodiment, a fixing device 34 comprises a fixing belt 50, a pressing roller 51, an electromagnetic induction heating coil unit 52, a nip pad 53 and an auxiliary heating plate 69. The fixing belt 50 includes a heating layer 50*a* serving as a conductive layer that generates heat through induction current. The electromagnetic induction heating coil unit 52 faces the fixing belt 50 in a thickness direction. The electromagnetic induction heating coil unit 52 serves as an induction current generating section which heats the heating layer 50*a* through electromagnetic induction heating. The auxiliary heating plate 69 faces the electromagnetic induction heating coil unit 52 across the fixing belt 50. The auxiliary heating plate 69 serves as an auxiliary heating section for increasing the calorific value in the electromagnetic induction heating process. The auxiliary heating plate 69 abuts against the inner peripheral surface of the fixing belt 50 across a coil side friction reducing member 84.

Hereinafter, an image forming apparatus 10 according to the first embodiment is described with reference to the accompanying drawings. In addition, the same components are indicated by the same reference numerals in the drawings.

FIG. 1 is a side view of the image forming apparatus 10 according to the first embodiment. Hereinafter, an MFP 10 is exemplified as one example of the image forming apparatus 10.

As shown in FIG. 1, the MFP 10 includes a scanner 12, a control panel 13, a paper feed cassette section 16, a paper feed tray 17, a printer section 18 and a paper discharge section 20. The MFP 10 includes a CPU 100 for controlling the whole MFP 10. The CPU 100 controls a main body control circuit 101 (refer to FIG. 2).

The scanner 12 reads a document image. The control panel 13 includes input keys 13*a* and a display section 13*b*. For example, the input keys 13*a* receive an input from a user. For example, the display section 13*b* is a touch panel type display. The display section 13*b* receives an input from the user and displays information to the user.

The paper feed cassette section 16 includes a paper feed cassette 16*a* and a pickup roller 16*b*. The paper feed cassette 16*a* stores a sheet P serving as an image receiving medium. The pickup roller 16*b* picks up the sheet P from the paper feed cassette 16*a*.

The paper feed cassette 16*a* feeds an unused (new) sheet P1 or a reusable sheet P2. The paper feed tray 17 feeds an unused (new) sheet P1 or a reusable sheet P2 through a pickup roller 17*a*.

The printer section 18 forms an image based on the document image read by the scanner 12. The printer section 18 includes an intermediate transfer belt 21. The printer section 18 supports the intermediate transfer belt 21 with a backup roller 40, a driven roller 41 and a tension roller 42. The backup roller 40 includes a driving section (not shown). The printer section 18 rotates the intermediate transfer belt 21 in a direction indicated by an arrow m.

The printer section 18 includes four image forming stations 22Y, 22M, 22C and 22K, each of which forms a Y (yellow), M (magenta), C (cyan) and K (black) image, respectively. The image forming stations 22Y, 22M, 22C and 22K are arranged side by side below the intermediate transfer belt 21 along the rotation direction of the intermediate transfer belt 21.

The printer section 18 includes a cartridge 23Y, 23M, 23C and 23K above each of the image forming stations 22Y, 22M, 22C and 22K. The cartridges 23Y, 23M, 23C and 23K stores Y (yellow), M (magenta), C (cyan) and K (black) toner for replenishment, respectively.

Hereinafter, the Y (yellow) image forming station 22Y within the image forming stations 22Y, 22M, 22C and 22K is exemplified. In addition, the image forming stations 22M, 22C and 22K are structurally identical to the image forming station 22Y, and therefore, the detailed description thereof is not repeated.

The image forming station 22Y includes an electrostatic charger 26, an exposure scanning head 27, a developing device 28 and a photoconductor cleaner 29. The electrostatic charger 26, the exposure scanning head 27, the developing device 28 and the photoconductor cleaner 29 are arranged around a photoconductive drum 24 which rotates in a direction indicated by an arrow n.

The image forming station 22Y includes a primary transfer roller 30. The primary transfer roller 30 is opposite to the photoconductive drum 24 across the intermediate transfer belt 21.

The image forming station 22Y exposes the photoconductive drum 24 with the exposure scanning head 27 after charges the photoconductive drum 24 with the electrostatic charger 26. Through the exposure processing, the image forming station 22Y forms an electrostatic latent image on the photoconductive drum 24. The developing device 28 develops the electrostatic latent image on the photoconductive drum 24 with the two-component developing agent including the toner and carrier.

For example, the toner is formed by containing a color material in binder resin. The color material contains at least color generation compound.

For example, the color generation compound may be leuco dye such as diphenylmethanephthalides and the like. The leuco dye is an electron-releasing compound which generates a color through color developing agent. For example, the color developing agent is an electron acceptability compound which gives proton to the leuco dye, such as phenols, metal salts of phenol and the like.

The binder resin may be resin having a low melting point or resin of which the glass transition point temperature Tg is low. For example, the binder resin includes polyester resin, polystyrene resin and the like. The binder resin may be selected according to the combined color material.

The primary transfer roller 30 primarily transfers the toner image formed on the photoconductive drum 24 to the intermediate transfer belt 21. The image forming stations 22Y, 22M, 22C and 22K forma color toner image on the intermediate transfer belt 21 through the primary transfer roller 30. The color toner image is formed by overlapping the Y (yellow), M (magenta), C (cyan) and K (black) toner images in sequence. The photoconductor cleaner 29 removes the toner left on the photoconductive drum 24 after the primary transfer.

The printer section 18 further includes a secondary transfer roller 32. The secondary transfer roller 32 is opposite to the backup roller 40 across the intermediate transfer belt 21. The secondary transfer roller 32 secondarily transfers the color toner images on the intermediate transfer belt 21 to the sheet P collectively. The sheet P is fed from the paper feed cassette section 16 or the manual feeding tray 17 along a conveyance path 33.

The printer section 18 includes a belt cleaner 43 opposite to the driven roller 41 across the intermediate transfer belt 21. The belt cleaner 43 removes the toner left on the intermediate transfer belt 21 after the secondary transfer. In addition, the image forming section includes the intermediate transfer belt 21, the four image forming stations 22Y, 22M, 22C and 22K, and the secondary transfer roller 32.

The printer section 18 includes a register roller 33*a*, a fixing device 34 and a paper discharge roller 36 along the conveyance path 33. The printer section 18 includes a branch section 37 and a reversal conveyance section 38 at the downstream side of the fixing device 34. The branch section 37 guides the sheet P subjected to fixing processing to the paper discharge section 20 or the reversal conveyance section 38. In a case of duplex printing, the reversal conveyance section 38 reversely conveys the sheet P guided by the branch section 37 to the direction of the register roller 33*a*. The MFP 10 forms a fixed toner image on the sheet P with the printer section 18 and then discharges the sheet P to the paper discharge section 20.

In addition, the MFP 10 is not limited to the tandem development type, and the number of the developing devices 28 is not limited. Further, the MFP 10 may directly transfer the toner image to the sheet P from the photoconductive drum 24.

Hereinafter, the fixing device 34 is described in detail.

Figure 2:
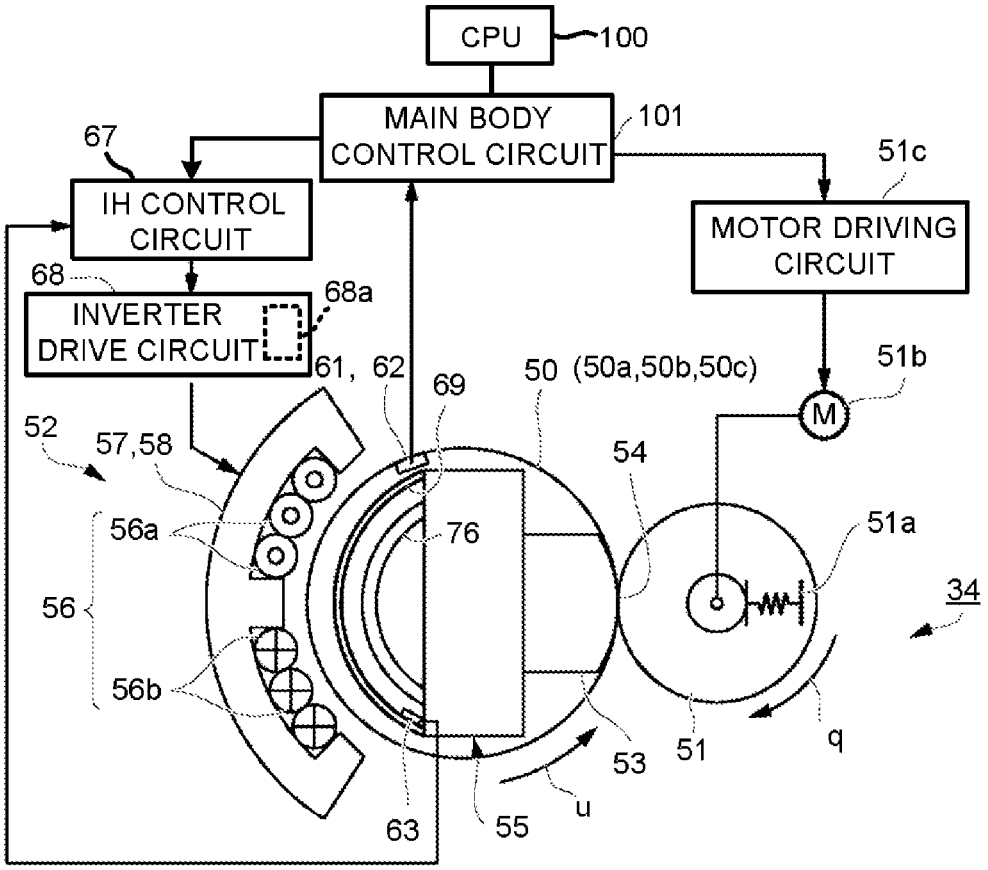
FIG. 2 is a side view of a fixing device including a control block of an IH coil unit according to the first embodiment.

FIG. 2 is a side view of the fixing device 34 including the control block of the electromagnetic induction heating coil unit 52 according to the first embodiment. Hereinafter, the electromagnetic induction heating coil unit is referred to as the "IH coil unit".

As shown in FIG. 2, the fixing device 34 includes a fixing belt 50, a pressing roller 51, the IH coil unit 52 and an auxiliary heating plate 69.

The fixing belt 50 is a cylindrical endless belt. A belt internal mechanism 55 including a nip pad 53 and the auxiliary heating plate 69 is arranged at the inner periphery of the fixing belt 50.

The fixing belt 50 is driven, through the rotation of the pressing roller 51, to rotate in a direction indicated by an arrow u, alternatively, the fixing belt 50 is rotated in a direction indicated by an arrow u independently. In a case in which the fixing belt 50 and the pressing roller 51 are rotated independently, an one-way clutch may be arranged so that no speed difference between the fixing belt 50 and the pressing roller 51 occurs.

The fixing belt 50 is formed by laminating a heating layer 50*a* serving as a heating section and a release layer 50*c* over a base layer 50*b* in sequence. In addition, the fixing belt 50 is not limited to a layer structure as long as the fixing belt 50 includes the heating layer 50*a*.

For example, the base layer 50*b* is formed by polyimide (PI) resin. For example, the heating layer 50*a* is formed by nonmagnetic metal such as copper (Cu) and the like. For example, the release layer 50*c* is formed by fluororesin such as copolymer (PFA) resin of tetrafluoroethylene and perfluoro alkyl vinyl ether.

The heating layer 50*a* is thinned to reduce the heat capacity so that the fixing belt 50 can carry out warming up rapidly. The fixing belt 50 with low heat capacity can reduce the time required for the warming up operation and save the consumption of power.

For example, the fixing belt 50 sets the thickness of the copper layer of the heating layer 50*a* to 10 μm to reduce the heat capacity thereof. For example, the heating layer 50*a* is covered by a protective layer such as a nickel layer and the like. The protective layer such as a nickel layer suppresses the oxidation of the copper layer and meanwhile improves the mechanical strength of the copper layer.

In addition, the heating layer 50*a* may be formed by carrying out electroless nickel plating and copper plating on the base layer 50*b* formed by the polyimide resin. The adhesion strength between the base layer 50*b* and the heating layer 50*a* and the mechanical strength of the heating layer 50*a* can be improved through the electroless nickel plating.

Further, the surface of the base layer 50*b* may be roughened through a sandblasting processing or a chemical etching processing. In this way, the adhesion strength between the base layer 50*b* and the nickel plating of the heating layer 50*a* can be further improved mechanically.

Further, metal such as titanium (Ti) and the like may be dispersed on the polyimide resin forming the base layer 50*b*. In this way, the adhesion strength between the base layer 50*b* and the nickel plating of the heating layer 50*a* can be improved.

For example, the heating layer 50*a* is formed by nickel, iron (Fe), stainless steel, aluminum (Al), silver (Ag) and the like. The heating layer 50*a* may be an alloy formed with two or more categories of metals; alternatively, the heating layer 50*a* may be formed by overlapping two or more categories of metals in a layer shape.

The heating layer 50*a* generates eddy current through the magnetic flux generated by the IH coil unit 52. The heating layer 50*a* generates joule heat through the eddy current and the electrical resistance of the heating layer 50*a* to heat the fixing belt 50.

Figure 3:
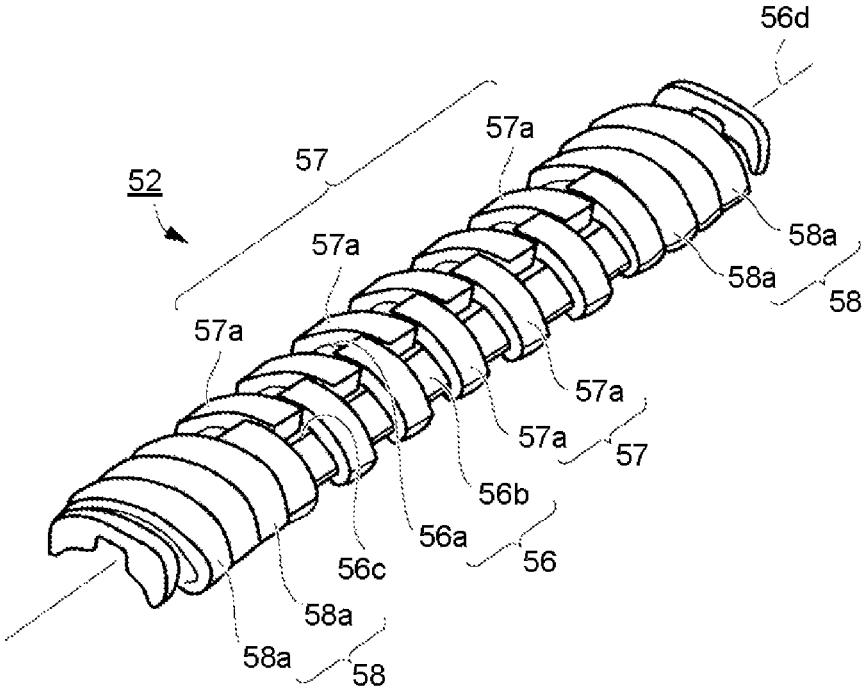
FIG. 3 is a perspective view illustrating of the IH coil unit according to the first embodiment.

FIG. 3 is a perspective view illustrating the IH coil unit 52 according to the first embodiment.

As shown in FIG. 3, the IH coil unit 52 includes coils 56, a first core 57 and a second core 58.

The coils 56 generate the magnetic flux through the application of high-frequency current. The coils 56 are opposite to the fixing belt 50 in the thickness direction. The coils 56 match the longitudinal direction in the width direction (hereinafter referred to as a "belt width direction") of the fixing belt 50.

The first core 57 and the second core 58 cover the side (hereinafter referred to as "back side") of the coils 56 opposite to the fixing belt 50. The first core 57 and the second core 58 prevent the magnetic flux generated by the coil 56 from being leaked from the back side, and concentrate the magnetic flux generated by the coil 56 to the fixing belt 50.

The first core 57 includes a plurality of single wing parts 57*a*. The plurality of single wing parts 57*a* are alternately arranged in a staggered manner by taking a center line 56*d* along the longitudinal direction of the coil 56 as an axis of symmetry.

The second core 58 is arranged at each of the both sides in the longitudinal direction of the first core 57. The second core 58 includes a plurality of two wings parts 58*a* straddling both wings of the coil 56.

For example, the single wing part 57*a* and the two wings part 58*a* are formed with magnetic materials such as nickel-zinc alloy (Ni—Zn), manganese-nickel alloy (Mn—Ni) and the like.

The first core 57 regulates the magnetic flux generated by the coil 56 with the plurality of single wing parts 57*a*. The magnetic flux generated by the coil 56 is regulated by each single wing of the coil 56 alternately with the center line 56*d* taken as an axis of symmetry. The first core 57 concentrates the magnetic flux generated by the coil 56 to the fixing belt 50 with the plurality of single wing parts 57*a*.

The second core 58 regulates the magnetic flux generated by the coil 56 with the plurality of two wings parts 58*a*. The magnetic flux generated by the coil 56 is regulated by the two wings of the coil 56 at the two sides of the first core 57. The second core 58 concentrates the magnetic flux generated by the coil 56 to the fixing belt 50 with the plurality of two wings parts 58*a*. The magnetic flux concentration force of the second core 58 is stronger than that of the first core 57.

The coil 56 includes a first wings 56*a* and a second wings 56*b*. The first wings 56*a* are arranged at one side of the center line 56*d*, while the second wings 56*b* are arranged at the other side of the center line 56*d*. A window portion 56*c* is formed at the inner side in the longitudinal direction of the coil 56, that is, the space between the first wings 56*a* and the second wings 56*b*.

As shown in FIG. 2, the IH coil unit 52 generates induction current when the fixing belt 50 is rotated in a direction indicated by an arrow u. Through the induction current, the heating layer 50*a* of the fixing belt 50 facing the IH coil unit 52 generates heat.

For example, the coil 56 may be a litz wire which is formed by bundling a plurality of copper wire materials covered by heat-resistant polyamide-imide serving as an insulation material. The coil 56 is formed by circulating a conductive core.

The coil 56 generates the magnetic flux through the application of high-frequency current from an inverter drive circuit 68. For example, the inverter drive circuit 68 includes an IGBT (Insulated Gate Bipolar Transistor) element 68*a*.

The auxiliary heating plate 69 is formed into an arc shape along the inner peripheral surface of the fixing belt 50. The auxiliary heating plate 69 is opposite to the first wings 56*a* and the second wings 56*b* of the coil 56 across the fixing belt 50. The auxiliary heating plate 69 receives the magnetic flux generated by the IH coil unit 52 to generate eddy current to generate heat. The auxiliary heating plate 69 assists in the heating of the fixing belt 50 while the heating layer 50*a* of the fixing belt 50 generates heat based on the IH coil unit 52.

The auxiliary heating plate 69 is supported by the shield 76 from the side opposite to the coil 56. Similar to the auxiliary heating plate 69, the shield 76 is also formed into an arc shape. The shield 76 is arranged at the inner periphery of the auxiliary heating plate 69. For example, the shield 76 is formed by a nonmagnetic material such as aluminum, copper and the like. The shield 76 shields the magnetic flux from the IH coil unit 52 and prevents the nip pad 53 and the like from being affected by the magnetic flux.

The auxiliary heating plate 69 is formed by a thin metal member of magnetic shunt alloy such as iron-nickel alloy and the like having a curie point of 220-230 degrees centigrade. If the temperature is higher than the curie point, the auxiliary heating plate 69 loses the magnetism and does not assist in the heating of the fixing belt 50. With the auxiliary heating plate 69, the fixing belt 50 is heated in a heat-resistant temperature range. The auxiliary heating plate and the fixing belt 50 are maintained in a contacted state, in this way, the temperature difference between the auxiliary heating plate 69 and the fixing belt 50 is suppressed. The frictional resistance caused by the contact between the auxiliary heating plate 69 and the fixing belt 50 becomes the drive load of the fixing belt 50.

In addition, the auxiliary heating plate 69 may be formed by a thin metal member having the magnetic properties of iron, nickel, stainless steel and the like. Alternatively, the auxiliary heating plate 69 may be formed by a material such as the resin and the like containing magnetic powder as long as the material has the magnetic properties. The auxiliary heating plate 69 may be formed by the following magnetic material (ferrite). The magnetic material (ferrite) promotes the heating of the fixing belt 50 through the magnetic flux based on the induction current and does not generate heat itself even if it is bathed in the magnetic flux based on the induction current. The auxiliary heating plate 69 is not limited to the thin plate member.

The both ends of the arc-shaped the auxiliary heating plate 69 are supported by the belt internal mechanism 55. For example, the upper end of the arc-shaped the auxiliary heating plate 69 is supported through a pivot shaft 69*a* (refer to FIG. 6) along the belt width direction. The lower end of the arc-shaped the auxiliary heating plate 69 is supported through an energization member 69*b* (refer to FIG. 6) such as a spring and the like. The auxiliary heating plate 69 is energized towards the inner peripheral surface of the fixing belt 50.

In addition, the auxiliary heating plate 69 may be energized towards the fixing belt 50 without pivoting. Further, the auxiliary heating plate 69 may be controlled to be contacted with and separated from the fixing belt 50. For example, the auxiliary heating plate 69 is separated from the fixing belt 50 before the warming up of the fixing device 34 and is contacted with the fixing belt 50 after the warming up.

Figure 4:
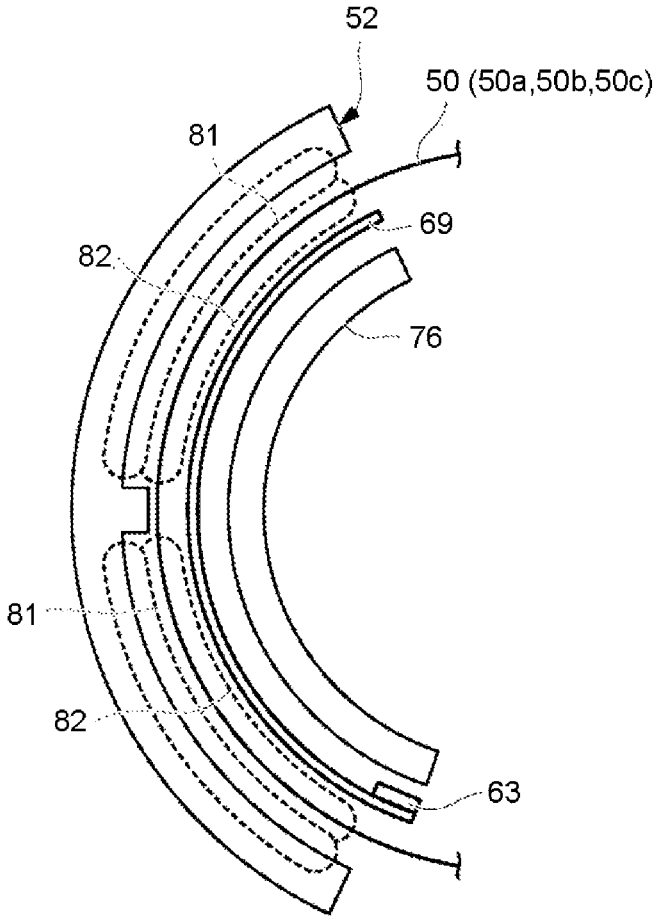
FIG. 4 is an illustration diagram of a magnetic path to a fixing belt and an auxiliary heating plate based on magnetic flux of the IH coil unit according to the first embodiment.

FIG. 4 is an illustration diagram of a magnetic path to the fixing belt 50 and the auxiliary heating plate 69 based on the magnetic flux of the IH coil unit 52 according to the first embodiment. For the sake of the convenience of description, the coil 56 and the like are not shown in FIG. 4, and the fixing belt 50 and the auxiliary heating plate 69 are separated from each other.

As shown in FIG. 4, the magnetic flux generated by the IH coil unit 52 is inducted to the heating layer 50*a* of the fixing belt 50 to forma first magnetic path 81. The magnetic flux generated by the IH coil unit 52 is inducted to the auxiliary heating plate 69 to form a second magnetic path 82.

The auxiliary heating plate 69 generates heat through the magnetic flux generated by the IH coil unit 52. The auxiliary heating plate 69 assists in the heating of the heating layer 50*a* of the fixing belt 50 during the warming up process of the fixing belt 50 to accelerate the warming up. The auxiliary heating plate 69 assists in the heating of the heating layer 50*a* of the fixing belt 50 during the printing process to maintain the fixing temperature.

As shown in FIG. 2, the nip pad 53 serves as a pressing section for pressing the inner peripheral surface of the fixing belt 50 against the pressing roller 51. In this way, a nip 54 is formed between the fixing belt 50 and the pressing roller 51. For example, the nip pad 53 is formed by heat-resistant polyphenylene sulfide resin (PPS), liquid crystal polymer (LOP), phenol resin (PF) and the like.

Figure 6:
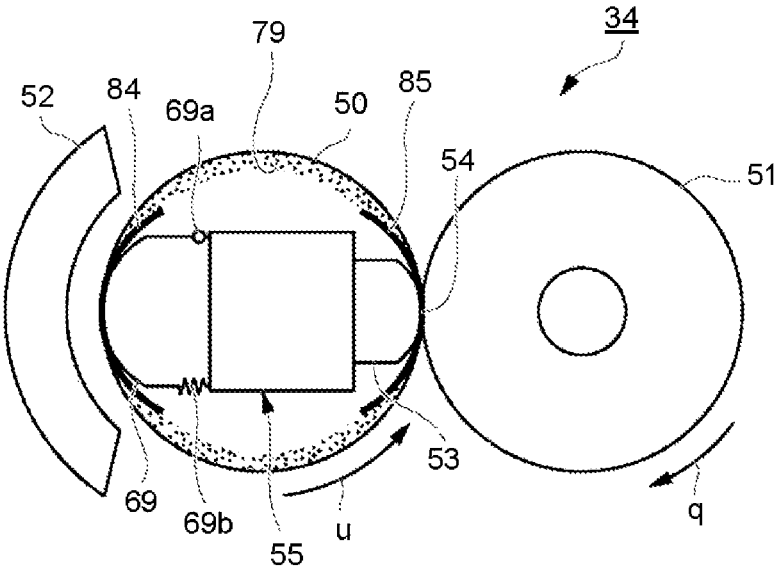
FIG. 6 is a side view illustrating the main portions of the fixing device according to the first embodiment.

FIG. 6 is a side view illustrating the main portions of the fixing device according to the first embodiment.

As shown in FIG. 6, a sheet-like nip side friction reducing member 85 is arranged between the nip pad 53 and the fixing belt 50. For example, the nip side friction reducing member 85 is formed with a sheet member having good sliding property and excellent abrasion resistance, and the release layer and the like. The nip side friction reducing member 85 is fixedly supported by the belt internal mechanism 55 to be in sliding contact with the inner peripheral surface of the rotating fixing belt 50. The nip side friction reducing member 85 may be formed by the following sheet member having lubricity. The sheet member may include a glass fiber sheet impregnated with fluororesin. The sheet member may include a material which contains graphite or carbon fiber. With such a sheet member, the frictional resistance between the fixing belt 50 and the nip pad 53 is reduced. The nip side friction reducing member 85, which is a thin film-like member, is low in the heat capacity and improves the heating of the fixing belt 50.

As shown in FIG. 2, for example, the pressing roller 51 includes heat-resistant silicon sponge, a silicon rubber layer and the like around a core bar. For example, a release layer is arranged on the surface of the pressing roller 51. The release layer is formed by fluorocarbon resin such as PFA resin and the like. The pressing roller 51 presses the fixing belt 50 through a pressing mechanism 51*a*. Similar to the nip pad 53, the pressing roller 51 also serves as a pressing section for pressing the fixing belt 50. The pressing roller 51 is rotated in a direction indicated by an arrow q by a motor 51*b*. The motor 51*b* is driven by a motor driving circuit 51*c* controlled by the main body control circuit 101.

A center thermistor 61 and an edge thermistor 62 detect the temperature of the fixing belt 50 and input the detected temperature to the main body control circuit 101. The center thermistor 61 is arranged at the inner side in the belt width direction. The edge thermistor 62 is arranged at a position more outer than the IH coil unit 52 in the belt width direction. The edge thermistor 62 detects, with high precision, the temperature of the outer side in the belt width direction of the fixing belt 50 without being affected by the IH coil unit 52.

The main body control circuit 101 controls an IH control circuit 67 according to the detection results of the center thermistor 61 and the edge thermistor 62. The IH control circuit 67 controls the magnitude of the high-frequency current output by the inverter drive circuit 68 under the control of the main body control circuit 101. The fixing belt 50 maintains various control temperature ranges according to the output of the inverter drive circuit 68.

The thermostat 63 functions as a safety device of the fixing device 34. The thermostat 63 operates when the fixing belt 50 is abnormally heated and the temperature of the fixing belt 50 rises to a cut-off threshold value. The current output to the IH coil unit 52 is cut off through the operation of the thermostat 63. When the current output to the IH coil unit 52 is cut off, the MFP 10 is no longer driven, and the abnormal heating of the fixing device 34 is suppressed.

A sheet-like coil side friction reducing member 84 is arranged between the fixing belt 50 and the auxiliary heating plate 69. For example, the coil side friction reducing member 84 is formed with a sheet member having good sliding property and excellent abrasion resistance, and the release layer and the like. The coil side friction reducing member 84 is fixedly supported by the belt internal mechanism 55 to be in sliding contact with the inner peripheral surface of the rotating fixing belt 50. The coil side friction reducing member 84 may be formed by the following sheet member having lubricity. The sheet member may include a glass fiber sheet impregnated with fluororesin. The sheet member may include a material which contains graphite or carbon fiber. With such a sheet member, the frictional resistance between the fixing belt 50 and the auxiliary heating plate 69 is reduced. The coil side friction reducing member 84, which is a thin film-like member, is low in the heat capacity and improves the heating of the fixing belt 50. The coil side friction reducing member 84 is formed by the same material as the nip side friction reducing member 85. The coil side friction reducing member 84 and the nip side friction reducing member 85 are arranged separately from each other. In addition, the coil side friction reducing member 84 and the nip side friction reducing member 85 may be formed by different materials according to the use parts. The coil side friction reducing member 84 and the nip side friction reducing member 85 are not limited to sheet-like shape as long as they are thin materials with low heat capacity.

A lubricant 79 is coated on the inner peripheral surface of the fixing belt 50. The lubricant 79 is oil formed with silicon or fluorine and the like. The lubricant 79 lubricates the inner peripheral surface of the fixing belt 50. The lubricant 79 reduces the frictional resistance between the inner peripheral surface of the fixing belt 50 and the nip side friction reducing member 85 and the coil side friction reducing member 84. The fixing belt 50 may be impregnated with the lubricant 79.

Hereinafter, a control system 110 of the IH coil unit 52 for enabling the fixing belt 50 to generate heat is described in detail.

Figure 5:
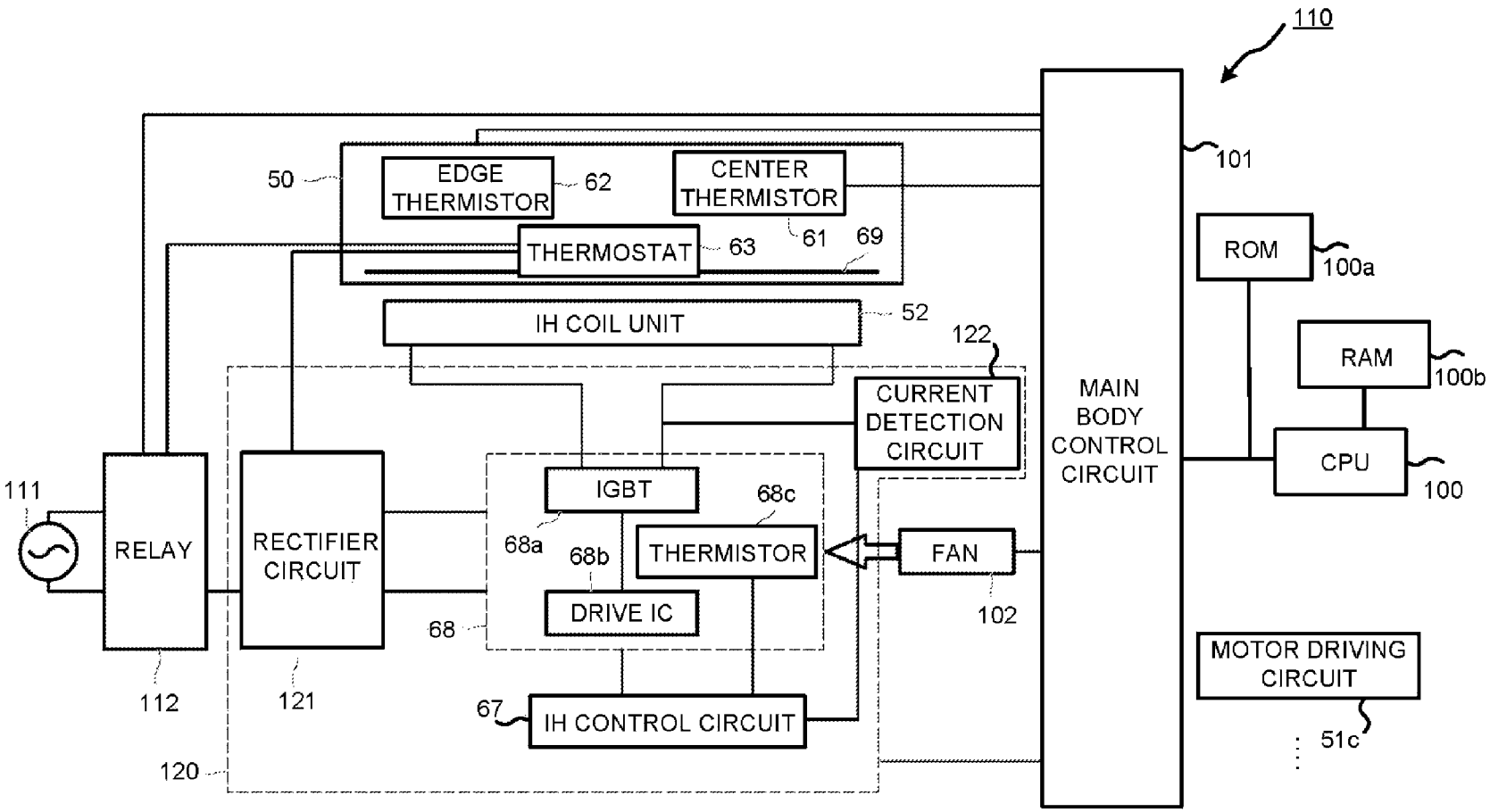
FIG. 5 is a block diagram illustrating a control system mainly for the control of the IH coil unit according to the first embodiment.

FIG. 5 is a block diagram illustrating the control system 110 mainly for the control of the IH coil unit 52 according to the first embodiment.

As shown in FIG. 5, the control system 110 includes a CPU 100, a read only memory (ROM) 100*a*, a random access memory (RAM) 100*b*, the main body control circuit 101, an IH circuit 120 and the motor driving circuit 51*c*.

The control system 110 supplies power for the IH coil unit 52 through the IH circuit 120. The IH circuit 120 includes a rectifier circuit 121, the IH control circuit 67, the inverter drive circuit 68 and a current detection circuit 122.

The current is input to the IH circuit 120 from an AC power supply 111 through a relay 112. The IH circuit 120 rectifies the input current with the rectifier circuit 121 and supplies the current to the inverter drive circuit 68. The relay 112 cuts off the current from the AC power supply 111 when the thermostat 63 is cut off. The inverter drive circuit 68 includes a drive IC 68*b* of an IGBT element 68*a* and a thermistor 68*c*. The thermistor 68*c* detects the temperature of the IGBT element 68*a*. In a case in which the thermistor 68*c* detects the temperature rise of the IGBT element 68*a*, the main body control circuit 101 drives a fan 102 to cool the IGBT element 68*a* down. The IH control circuit 67 controls the drive IC 68*b* according to the detection results of the center thermistor 61 and the edge thermistor 62. The IH control circuit 67 controls the drive IC 68*b* to control the output of the GBT element 68*a*. The current detection circuit 122 sends the detection result of the output of the IGBT element 68*a* to the IH control circuit 67. The IH control circuit 67 controls the drive IC 68*b* according to the detection result of the current detection circuit 122 so that the power supplied to the coil 56 is constant Hereinafter, the operation of the fixing device 34 in the warming up process is described.

As shown in FIG. 2, in the warming up process, the fixing device 34 rotates the pressing roller 51 in a direction indicated by an arrow q, and in this way, the fixing belt 50 is driven to rotate in a direction indicated by an arrow u. The IH coil unit 52 generates the magnetic flux to the fixing belt 50 through the application of the high-frequency current based on the inverter drive circuit 68.

As shown in FIG. 4, the magnetic flux of the IH coil unit 52 is inducted to the first magnetic path 81 passing through the heating layer 50*a* of the fixing belt 50, in this way, the heating layer 50*a* generates heat. The magnetic flux of the IH coil unit 52 passing through the fixing belt 50 is inducted to the second magnetic path 82 passing through the auxiliary heating plate 69, in this way, the auxiliary heating plate 69 generates heat.

The heat of the auxiliary heating plate 69 is transferred to the fixing belt 50 through the coil side friction reducing member 84. The transfer of heat from the auxiliary heating plate 69 to the fixing belt 50 encourages the rapid warming up of the fixing belt 50.

As shown in FIG. 2, the IH control circuit 67 controls the inverter drive circuit 68 according to the detection results of the center thermistor 61 or the edge thermistor 62. The inverter drive circuit 68 supplies the high-frequency current to the coil 56.

Hereinafter, the operation of the fixing device 34 in the fixing operation is described.

After the temperature of the fixing belt 50 reaches the fixing temperature and the warming up is completed, if there is a printing request, the MFP 10 (refer to FIG. 1) starts the printing operation. The MFP 10 forms a toner image on the sheet P in the printer section 18 and then conveys the sheet P to the fixing device 34.

The MFP 10 passes the sheet P on which the toner image is formed through the nip 54 between the fixing belt 50 reaching the fixing temperature and the pressing roller 51. The fixing device 34 fixes the toner image on the sheet P. During the fixing process, the IH control circuit 67 controls the IH coil unit 52 to maintain the fixing belt 50 at the fixing temperature.

Through the fixing operation, the heat of the fixing belt 50 is absorbed by the sheet P. For example, in a case of passing sheets continuously at a high speed, a large quantity of heat is absorbed by the sheet P. At this time, there is a case in which the fixing belt 50 with low heat capacity cannot be maintained at the fixing temperature. Through the transfer of heat from the auxiliary heating plate 69 to the fixing belt 50, the fixing belt 50 can be heated from the inner periphery thereof, which can compensate for the insufficiency of belt calorific value. The heating of the fixing belt 50 based on the auxiliary heating plate 69 can maintain the temperature of the fixing belt 50 at the fixing temperature even in the case of passing sheets continuously at a high speed In a case in which the auxiliary heating plate 69 is contacted with the fixing belt 50, if the frictional resistance between the auxiliary heating plate 69 and the fixing belt 50 is large, the drive load of the fixing device 34 is increased. However, the sheet-like coil side friction reducing member 84 (refer to FIG. 6) is arranged between the fixing belt 50 and the auxiliary heating plate 69, the frictional resistance can be reduced. Further, the lubricant 79 (refer to FIG. 6) is coated between the coil side friction reducing member 84 and the fixing belt 50, the frictional resistance can be further reduced.

In accordance with the first embodiment, the coil side friction reducing member 84 is arranged between the auxiliary heating plate 69 and the fixing belt 50. With the coil side friction reducing member 84, the frictional resistance between the fixing belt 50 and the auxiliary heating plate 69 is reduced. Thus, even if the auxiliary heating plate 69 is contacted with the fixing belt 50, the increase in the drive load of the fixing device 34 can be suppressed and the fixing operation can be speeded up.

The lubricant 79 is coated between the sheet-like coil side friction reducing member 84 and the fixing belt 50. With the lubricant 79, the frictional resistance between the inner peripheral surface of the fixing belt 50 and the coil side friction reducing member 84 is reduced. Thus, the increase in the drive load of the fixing device 34 can be suppressed actually and the fixing operation can be further speeded up.

The nip side friction reducing member 85 is arranged between the nip pad 53 and the fixing belt 50 which form the nip 54. With the nip side friction reducing member 85, the frictional resistance between the fixing belt 50 and the nip pad 53 is reduced. Thus, even if the nip pad 53 is contacted with the fixing belt 50, the drive load of the fixing device 34 is suppressed, and the fixing operation can be speeded up.

Hereinafter, a fixing device 34' according to the second embodiment is described.

Figure 7:
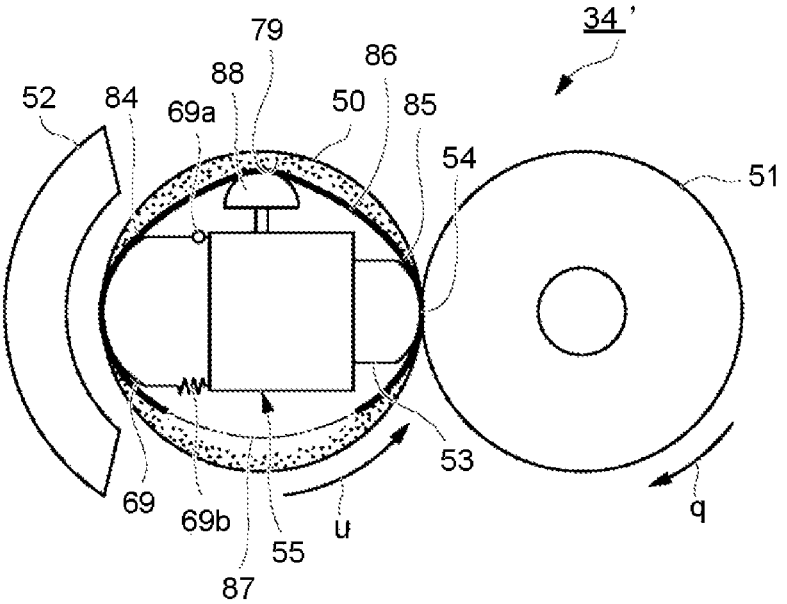
FIG. 7 is a side view illustrating the main portions of a fixing device according to a second embodiment.

FIG. 7 is a side view illustrating the main portions of the fixing device according to the second embodiment.

As shown in FIG. 7, in the second embodiment, an upper connection section 86 is arranged to connect the upper end of the coil side friction reducing member 84 with the upper end of the nip side friction reducing member 85. The second embodiment is different from the first embodiment in a point where the coil side friction reducing member 84 and the nip side friction reducing member 85 are arranged integrally. In the second embodiment, the same reference numerals indicate the same components as those described in the first embodiment, and the detailed description is not repeated.

The coil side friction reducing member 84 and the nip side friction reducing member 85 are integrated through the upper connection section 86 that connects the upper ends thereof. The coil side friction reducing member 84, the nip side friction reducing member 85 and the upper connection section 86 cover the belt internal mechanism 55 from above. If the lubricant 79 drops from the upper portion of the inner peripheral surface of the fixing belt 50 to the belt internal mechanism 55, the lubricant 79 coated on the inner peripheral surface of the fixing belt 50 is reduced. In this case, there is a possibility that the lubricant 79 is depleted from the inner peripheral surface of the fixing belt 50. If the lubricant 79 drops from the fixing belt 50 to the upper connection section 86, the lubricant 79 returns to the inner peripheral surface of the fixing belt 50. In this way, the reduction of the lubricant 79 can be suppressed. The upper connection section 86 is supported to be a roof shape by a support member 88 arranged on the belt internal mechanism 55. The coil side friction reducing member 84, the nip side friction reducing member 85 and the upper connection section 86 adhere to the inner peripheral surface of the fixing belt 50 across the lubricant 79. The coil side friction reducing member 84, the nip side friction reducing member 85 and the upper connection section 86 are along the fixing belt 50 when the fixing belt 50 is rotating.

In addition, the coil side friction reducing member 84 and the nip side friction reducing member 85 may also be integrated through a lower connection section 87 that connects the lower ends thereof. At this time, the coil side friction reducing member 84, the nip side friction reducing member 85 and the upper and the lower connection sections 86 and 87 may be connected in an annular shape. In this case, the assembling of the fixing belt 50 can be carried out easily, and the number of manufacturing steps and maintenance steps of the fixing device 34' can be reduced.

In accordance with at least one embodiment described above, the coil side friction reducing member 84 is arranged between the auxiliary heating plate 69 and the fixing belt 50. With the coil side friction reducing member 84, the frictional resistance between the auxiliary heating plate 69 and the fixing belt 50 is reduced. Thus, even if the auxiliary heating plate 69 is contacted with the fixing belt 50, the increase in the drive load of the fixing device 34 or 34' can be suppressed and the fixing operation can be speeded up.

Further, the lubricant 79 is coated between the sheet-like coil side friction reducing member 84 and the fixing belt 50. With the lubricant 79, the frictional resistance between the inner peripheral surface of the fixing belt 50 and the coil side friction reducing member 84 is reduced. Thus, the increase in the drive load of the fixing device 34 or 34' can be suppressed actually and the fixing operation can be further speeded up.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device comprising:

a fixing belt configured to be provided with a conductive layer, wherein the fixing belt is an endless belt;

an induction current generating section configured to face the fixing belt in a thickness direction to heat the conductive layer through electromagnetic induction heating, wherein the induction current generating section is configured at an outer periphery side of the fixing belt;

an auxiliary heating section configured to face the induction current generating section across the fixing belt to increase the calorific value in the electromagnetic induction heating process, wherein the auxiliary heating section is configured at an inner periphery side of the fixing belt; and a friction reducing member configured to be nipped between the auxiliary heating section and the fixing belt, wherein the friction reducing member is configured to be supported on the auxiliary heating section;

a pressing roller configured at the outer periphery side of the fixing belt avoiding the induction current generating section;

a nip pad configured at the inner periphery side of the fixing belt avoiding the auxiliary heating section and configured to face the pressing roller across the fixing belt;

a sheet-like second friction reducing member configured to be nipped between the nip pad and the fixing belt and supported on the nip pad; and a connection section configured to connect the friction reducing member with the second friction reducing member integrally.

2. The fixing device according to claim 1, wherein the friction reducing member is a sheet member supported on the auxiliary heating section; and a lubricant is supplied between the friction reducing member and the fixing belt.

3. The fixing device according to claim 1, wherein the lubricant is supplied between the fixing belt and the friction reducing member and the second friction reducing member; and the friction reducing member, the second friction reducing member and the connection section cover the auxiliary heating section and the nip pad from above.

4. The fixing device according to claim 3, further comprising:

a support section configured to support the connection section.

5. The fixing device according to claim 1, wherein the auxiliary heating section is constituted by a metal material having a curie point.

6. The fixing device according to claim 1, wherein the friction reducing member is constituted by a sheet member including a glass fiber sheet impregnated with fluororesin.

7. The fixing device according to claim 1, wherein the friction reducing member is constituted by a sheet member including a material containing graphite or carbon fiber.

8. An image forming apparatus comprising:

an image forming section configured to form an image on an image receiving medium; and the fixing device according to claim 1 configured to fix the image on the image receiving medium.

9. A drive load reduction method of a fixing device which comprises a fixing belt provided with a conductive layer; an induction current generating section configured to face the fixing belt in a thickness direction to heat the conductive layer through electromagnetic induction heating; an auxiliary heating section configured to face the induction current generating section across the fixing belt to increase the calorific value in the electromagnetic induction heating process; and a nip pad configured at an inner periphery side of the fixing belt avoiding the auxiliary heating section and configured to face a pressing roller across the fixing belt, including:

nipping a friction reducing member between the auxiliary heating section and the fixing belt;

nipping a second friction reducing member between the nip pad and the fixing belt and supported on the nip pad; and connecting the friction reducing member with the second friction reducing member integrally.

* * * * *